US008770084B2

(12) United States Patent
Young

(10) Patent No.: US 8,770,084 B2
(45) Date of Patent: Jul. 8, 2014

(54) SUPPRESSOR ASSEMBLY FOR FIREARMS

(76) Inventor: Nicholas E. Young, Murray, UT (US)

( * ) Notice: Subject to any disclaimer, the term of this patent is extended or adjusted under 35 U.S.C. 154(b) by 0 days.

(21) Appl. No.: 13/340,037

(22) Filed: Dec. 29, 2011

(65) Prior Publication Data

US 2012/0167749 A1 Jul. 5, 2012

Related U.S. Application Data

(60) Provisional application No. 61/429,858, filed on Jan. 5, 2011.

(51) Int. Cl.
*F41A 21/30* (2006.01)

(52) U.S. Cl.
CPC ..... *F41A 21/30* (2013.01)
USPC ..... 89/14.3; 89/14.4; 181/223

(58) Field of Classification Search
USPC ..... 89/14.3–14.4; 181/223
See application file for complete search history.

(56) References Cited

U.S. PATENT DOCUMENTS

| | | | | |
|---|---|---|---|---|
| 4,716,809 | A * | 1/1988 | A'Costa | 89/14.3 |
| 5,698,810 | A * | 12/1997 | Rose | 89/14.3 |
| 6,722,254 | B1 * | 4/2004 | Davies | 89/14.3 |
| 2008/0083321 | A1 * | 4/2008 | Dueck et al. | 89/14.3 |

* cited by examiner

*Primary Examiner* — Stephen M Johnson
*Assistant Examiner* — Benjamin Gomberg

(57) ABSTRACT

A suppressor system includes at least one inner core having a core bore defined therein, the core bore having a nominal core bore diameter. The inner core also includes a core-coupling portion. A plurality of muzzle brakes that each includes a bore having a nominal brake bore diameter. Each muzzle brake includes a brake-coupling portion. The inner core is configured to allow the brake-coupling portions of muzzle brakes having nominal brake bore diameters that are equal to or less than the nominal core bore diameter to couple to the core-coupling portion and to prevent the brake-coupling portions of muzzle brakes having nominal brake diameters that are greater than the nominal core diameter from coupling to the core-coupling portion.

17 Claims, 3 Drawing Sheets

SUPPRESSOR ASSEMBLY FOR FIREARMS

RELATED APPLICATIONS

This application claims the benefit of U.S. Provisional Patent Application Ser. No. 61/429,858 filed Jan. 5, 2011 and entitled "SUPPRESSOR SYSTEM FOR FIREARMS," the disclosure of which is hereby incorporated by reference in its entirety.

BACKGROUND

Cartridges contain powder that generates a rapidly expanding gas when combusted. When the cartridge is fired, the rapid expansion of the gas generates pressure that drives a bullet from the chamber and out of the muzzle. As the gas exits the muzzle of the firearm to the environment, the gas further expands thereby generating a report, which can be extremely loud.

Suppressors reduce the report of a firearm by controlling how the gas is exhausted. In particular, the expansion gas changes directions and expands over a larger distance and thus a longer period of time. It may be desirable to securely couple the suppressor to the muzzle. It may also be desirable to allow interchangeability whenever possible while still providing safety.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

In at least one example, a suppressor system includes at least one inner core having a core bore defined therein, the core bore having a nominal core bore diameter. The inner core also includes a core coupling portion. A plurality of muzzle brakes each includes a bore having a nominal brake bore diameter. Each muzzle brake includes a brake-coupling portion. The inner core is configured to allow the brake-coupling portions of muzzle brakes, having nominal brake bore diameters that are equal to or less than the nominal core bore diameter, to couple to the core-coupling portion and to prevent the brake-coupling portions of muzzle brakes, having nominal brake diameters that are greater than the nominal core diameter, from coupling to the core-coupling portion.

In other examples, a suppressor system includes at least one inner core having a core-coupling portion and further including a core bore and a brake receiving recess defined therein. The core bore has a nominal core bore diameter. A plurality of muzzle brakes each have a brake bore defined therein. Each of the muzzle brakes also includes a protrusion and a brake-coupling portion. Muzzle brakes that have nominal brake bore diameters that are equal to or less than the nominal core bore diameter have protrusions sized to be sufficiently received within the brake receiving recess to allow the core-coupling portions to engage the brake-coupling portions to thereby couple the inner core to the muzzle brakes.

A suppressor system includes a first inner core. A first core bore is defined in the first inner core and has a first nominal core bore diameter. A first brake receiving recess is also defined in the first inner core that has a first recess length. A first brake coupling portion associated with the first brake receiving recess. The suppressor system also includes a second inner core. A second core bore is defined in the second inner core and has a second nominal core bore diameter. The second nominal core bore diameter is smaller than then the first nominal core bore diameter. A second brake receiving recess is also defined in the second inner core that has a second recess length. A second brake coupling portion associated with the second brake receiving recess. The second recess length is shorter than the first recess length. A first muzzle brake has a first brake bore defined therein having a first nominal brake bore diameter. The first nominal brake bore is equal to or less than the first nominal core bore diameter and a first protrusion configured to be received within the first brake receiving recess to allow the first inner core to couple to the first muzzle brake. A second muzzle brake is configured to couple to the second inner core and having a second brake bore defined therein having a second nominal brake bore diameter, the second nominal brake bore being equal to or less than the second nominal core bore diameter, and a second protrusion configured to be received within the second brake receiving recess to allow the second inner core to couple to the second muzzle brake, wherein the second protrusion is of a length to be received within the first brake receiving recess to allow the second muzzle brake to couple with the first inner core and the first protrusion of a length to prevent the first muzzle brake from coupling with the second inner core.

BRIEF DESCRIPTION OF THE DRAWINGS

To further clarify various aspects of some example embodiments of the present invention, a more particular description of the invention will be rendered by reference to specific embodiments thereof, which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Suppressor assemblies are provided herein that are configured to cooperate with exhaust gases generated by firing cartridges from a rifle to generate tightening forces that act to tighten the coupling of the suppressor assembly to the associated rifle. In at least one example, these rotational forces may be in the same direction in which some component of the suppressor system is rotated to couple the suppressor system 200 to the muzzle of the barrel of the rifle. In some examples, the suppressor system includes an inner core that couples the suppressor assembly to the muzzle of the barrel of a firearm. In particular, in some examples the inner core may couple to a muzzle brake that in turn is coupled to or integrated with the muzzle of the barrel.

In at least one example, a suppressor assembly may include a plurality of muzzle brakes that allow for selected compatibility. In particular, muzzle brakes may be configured to allow a given muzzle brake to couple with inner cores having bores of the same or larger diameters while preventing coupling of that muzzle brake to inner cores with bores having smaller diameters than the muzzle brake. Such a configuration can allow interchangeability of the suppressor assembly with various rifles while minimizing incompatible coupling of inner cores and muzzle brakes (and the associated barrels).

Figure 1:
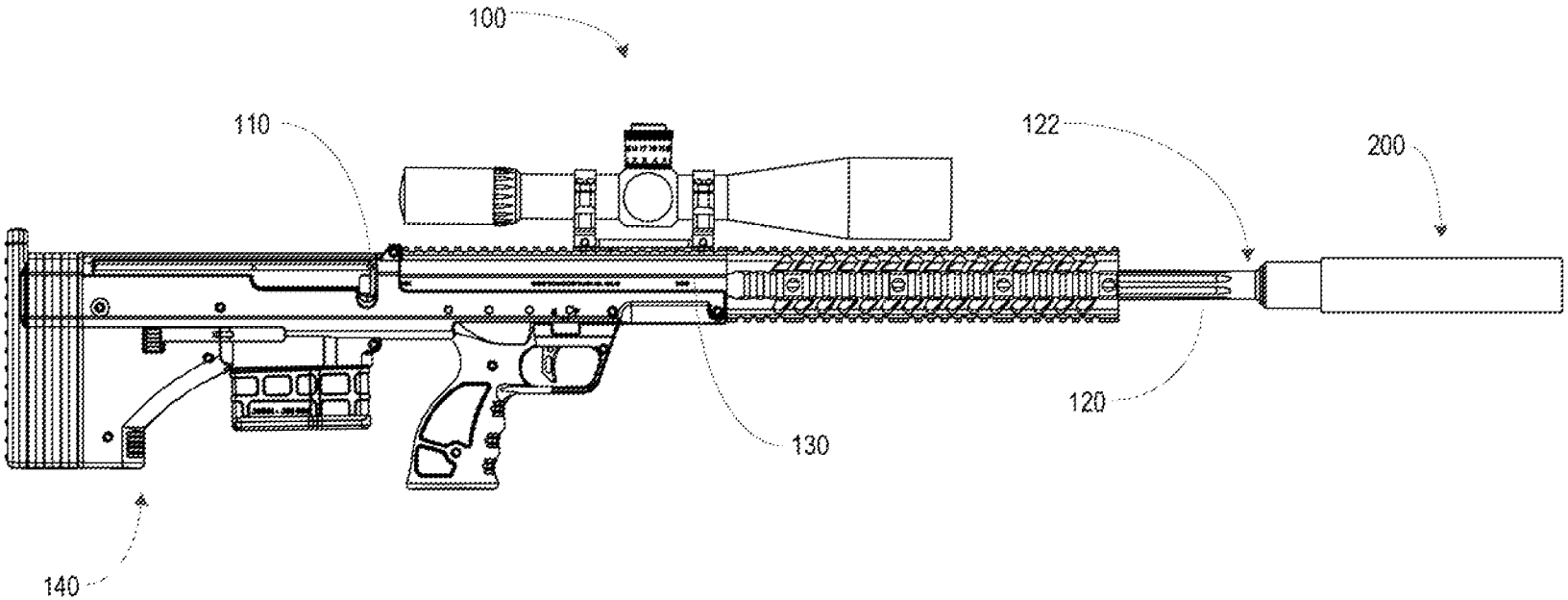
FIG. 1 illustrates a firearm with a suppressor system coupled thereto according to one example.

FIG. 1 illustrates a firearm 100 with at least a portion of a suppressor system 200 coupled thereto. As illustrated in FIG. 1, the firearm 100 is configured as a rifle and generally includes an action 110 and a barrel 120 coupled to the action 110. In the illustrated example, a receiver 130 couples the action 110 and the barrel 120 and maintains the barrel 120 in an aligned position relative to the rest of the firearm 100. A stock assembly 140 may be coupled to the receiver 130 as desired. Though a rifle configuration is shown, it will be appreciated that the suppressor system 200 will be utilized with any firearm desired.

Regardless of the type of firearm to which the suppressor system 200 may be coupled, the action 110 is operated to ignite powder in a cartridge to generate pressurized gases that propel the projectile from the barrel 120. As the bullet exits the barrel 120, the pressurized gas rapidly expands generating a report. The report can be very loud without the suppressor system 200 coupled to the barrel 120, depending on the charge of the cartridge. As will be discussed in more detail hereinafter, the suppressor system 200 is configured to control the speed and direction of exhaust gas to reduce the report of firing the rifle 100.

The suppressor system 200 is configured to be removably coupled to a muzzle 122 of the barrel 120. In at least one example, the suppressor system 200 is removably coupled to the muzzle 122 by rotating some portion of the suppressor system 200 relative to the muzzle 122. For example, some portion of the suppressor system 200 may be rotated in a clockwise manner to thread the suppressor system 200 onto the muzzle 122, though it will be appreciated that other coupling configurations are possible.

Figure 2A:
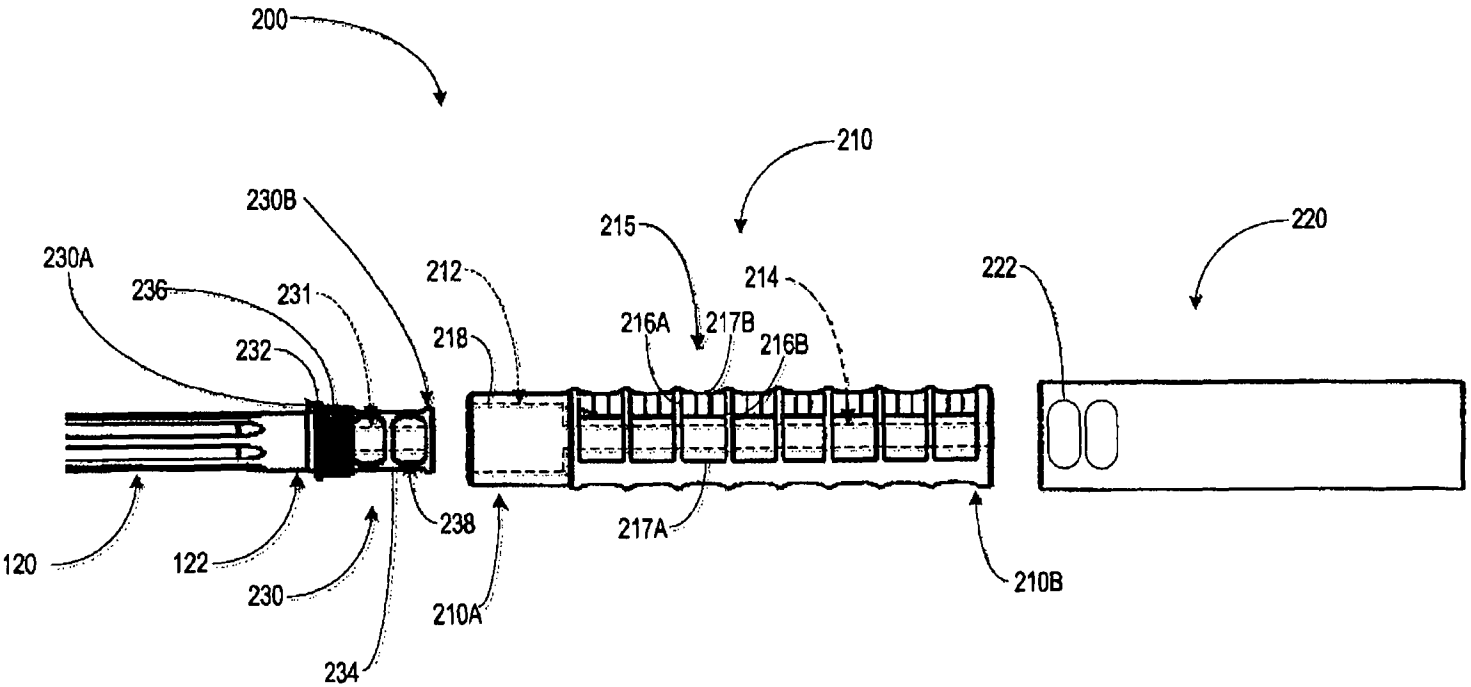
FIG. 2A illustrates an exploded view of the suppressor system in proximity with the firearm.
Figure 2B:
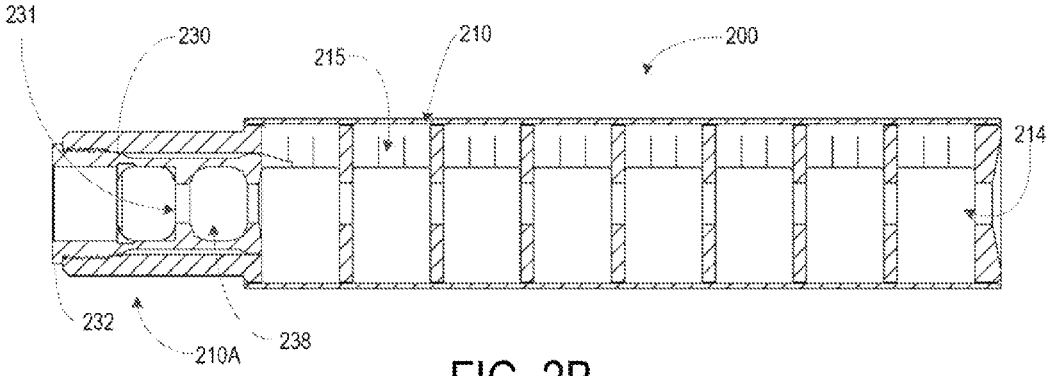
FIG. 2B illustrates a cross-sectional view of the suppressor system taken along section 2-2 of FIG. 1.

One such exemplary configuration is shown in FIGS. 2A and 2B. FIG. 2A illustrates an exploded view of a portion of the suppressor system 200 in proximity with the firearm 100. In at least one example, the suppressor system 200 generally includes an inner core 210 and an outer sleeve 220. In at least one example, the suppressor system 200 also includes one or more muzzle brake 230. Though the muzzle brake 230 is discussed as being part of the suppressor system 200, it will be appreciated that the muzzle brake 230 may be included with or integrated with the muzzle 122 as desired.

As illustrated in FIGS. 2A and 2B, the suppressor system 200 may be assembled by covering the inner core 210 with the outer sleeve 220. In at least one example, this may be accomplished by placing the inner core 210 at least partially within the outer sleeve 220. The outer sleeve 220 may be secured in place over the inner core 210 in any suitable manner. In at least one example, the outer sleeve 220 may be welded to the inner core 210. In other examples, threads or some other coupling may be used as desired.

The muzzle brake 230 may be at least partially received within and threadingly coupled to the inner core 210, as will be discussed in more detail at appropriate points hereinafter. The muzzle brake 230 may be threadingly coupled to or integrated with a muzzle of a barrel as desired.

As illustrated in FIG. 2A, the inner core 210 includes a first end 210A and a second end 210B. A brake-receiving recess 212 is defined in the first end 210A. The brake-receiving recess 212 is configured to receive a predetermined portion of the muzzle brake 230 therein. The inner core 210 and a bore 231 of the muzzle brake 230 have similar bore diameters and are configured to couple together. According to the present suppressor system 200, the inner core 210 is further configured to couple to muzzle brakes having smaller bore diameters. A more detailed discussion of the interaction of the muzzle brake 230 and the first end 210A, and the interaction of the muzzle brake and the brake-receiving recess 212 in particular, will be discussed in more detail at an appropriate point hereinafter.

With continuing reference to FIG. 2A, the inner core 210 includes an axial opening, referred to as a bore 214, defined therein. The bore 214 extends through the first end 210A and the second end 210B of the inner core 210 thereby defining a central axis through the inner core 210. The bore 214 of the inner core 210 is configured to be aligned with the bore of the barrel 120 to thereby allow a projectile to pass from the muzzle 122 of the barrel 120 through the inner core 210.

The inner core 210 is configured to change the direction and speed of exhaust gasses that enter the suppressor 200. In the illustrated example, the inner core 210 includes channels defined therein that form core baffles 215. The core baffles 215 are configured to interact with exhaust gasses passing through the inner core 210 in such a manner as to rotate the inner core 210 in the same direction the suppressor 200 rotates to couple the suppressor 200 to the muzzle 122 (FIG. 1). In the illustrated example, the core baffles 215 act on the exhaust gas to rotate the inner core 210 in the same direction the inner core 210 rotates to couple the inner core 210 to the muzzle brake 230. Such a configuration may allow exhaust gases to tighten the inner core 210 to the muzzle brake 230, thereby helping ensure the suppressor 200 remains coupled to the barrel 120.

The core baffles 215 or other components may be configured as desired to provide the rotational forces described above. Still referring to FIG. 2A, the core baffles 215 include opposing transverse edges 216A, 2168 and opposing axial edges 217A, 2178. The opposing transverse edge 216A, 216B and the opposing axial edges 217A, 217B are each oriented at an angle relative to the central axis defined by the bore 214. The opposing transverse edges 216A, 216B may be oriented at any desired angles relative to the opposing axial edges 217A, 217B. In some examples, the transverse edges 216A, 216B and the axial edges 217A, 217B, as well as the intersections therebetween cooperate to direct exhaust gasses in such a manner as to tighten the inner core 210 to the muzzle brake 230. Various configurations may be possible, one of which will now be discussed in more detail.

In the example shown in FIG. 2A, the transverse edges 216A, 216B may be generally perpendicular to an axis defined by the bore 214. Further, the transverse edges 216A, 216B are generally parallel to each other. Accordingly, in at least one example the transverse edges 216A, 216B may be substantially similar to each other.

As further shown in FIG. 2A, the axial edges 217A, 217B may be different from one another. In particular, the axial edge 217A may intersect at angles with the transverse edges 216A, 216B. In the illustrated example, the axial edge 217A intersects with the transverse edges 216A, 216B at right angles. Further, the axial edge 217A may be a generally straight edge that is parallel to the axis defined by the bore 214. In other examples, the axial edge 217A may intersect the transverse edges 216A, 216B at different angles and/or may be other than a straight edge.

In the illustrated example, intersections between the axial edge 217B and the transverse edges 216A, 216B may be radiused such that the intersections are rounded. For example, the intersections may each be rounded with a 0.25 inch radius or greater. It will be appreciated that the other configurations may be implemented to provide the functionality of directing the exhaust gas to rotate the inner core 210 in the desired direction.

As illustrated in FIG. 2A, the muzzle brake 230 includes a shoulder 232 adjacent a first end 230A of the muzzle brake 230, a protrusion 234 that extends away from the shoulder 232 forming the second 230B of the muzzle brake 230, and an exterior coupling portion 236 positioned near or adjacent the shoulder 232. One or more brake baffles 238 are defined in the protrusion 234. As further shown in FIG. 2A, the inner core 210 has an interior coupling portion 218 adjacent the first end 210A of inner core 210.

The interior coupling portion 218 is configured to couple with the coupling portion 234 on the muzzle brake 230 to thereby couple the inner core 210 to the muzzle brake 230. In the illustrated example, the interior coupling portion 218 and the coupling portion 234 are configured to be threadingly coupled. Accordingly, the interior coupling portion 218 may include interior threads and the exterior coupling portion 234 may include exterior threads.

FIG. 2B illustrates a cross-sectional view of the suppressor 200 taken along section 2-2 of FIG. 1 and illustrates the interaction between the muzzle brake 230 and the inner core 210 when the inner core 210 is coupled to the muzzle brake 230. In particular, when the inner core 210 is thus coupled to the muzzle brake 230 the interior coupling portion 218 is engaged with the exterior coupling portion 236. Further, the protrusion 234 is at least partially received within the brake receiving recess 212 to thereby position the brake baffles 238 within the first end 210A of the inner core 210. In at least one example, the first end 210A of the inner core 210 seats against the shoulder 232 when the inner core 210 is coupled to the muzzle brake 230.

When the muzzle brake 230 is coupled to the inner core 210, the bores 214, 231 are aligned. With the bores 214, 231 thus aligned, exhaust gases from the muzzle 122 of the barrel 120 are directed toward bore 214 of the inner core 210. A portion of the gasses directed through the bore 214 will be directed laterally through the core baffles 215 where the transverse edges 216A, 216B direct the gasses to the axial edges 217A, 217B (FIG. 2A).

Various physical phenomena may occur to cause the gasses to exert rotational forces on the inner core 210. For example, the differentially configured axial edges 217A, 217B may cause the gasses to exert differential forces on the edges, thereby causing the gasses to exert rotational forces on the inner core 210. In at least one, example, the inner core 210 may be configured to cause these forces to act to tighten the inner core 210 to the muzzle brake 230. Such a configuration may help ensure the suppressor system 200 will remain coupled to the associated firearm. As will now be discussed in more detail, inner cores and muzzle brakes may be provided that allow for compatibility of inner cores with muzzle brakes with the same or smaller nominal bore diameters while minimizing unintended use of inner cores with muzzle brakes with larger nominal bore diameters.

In general, the first end (proximate the muzzle of an associated rifle) of an inner core is internally threaded while the first end of a muzzle brake is externally threaded. In the example illustrated in FIG. 2B, the inner core 210 and the muzzle brake 230 have the same nominal bore diameter, and thus the muzzle break 230 has the largest nominal bore that should be allowed to couple to the muzzle brake 230. In such an example, the muzzle brake 230 may be nearly completely received within the inner core 210 when the muzzle brake 230 and the inner core 210 are coupled together, such as when the inner core 210 is threaded onto the muzzle brake 230.

Figure 3:
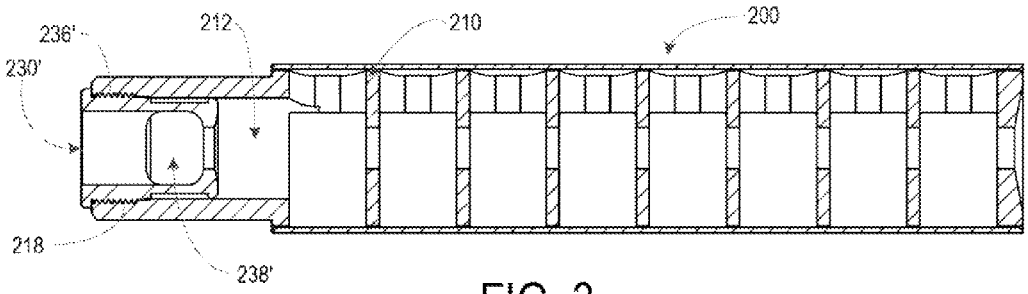
FIG. 3 illustrates a cross sectional view of a suppressor system, according to one example.

FIG. 3 illustrates an example in which the same inner core 210 shown in FIG. 2B is coupled to a muzzle brake 230' having a nominal size smaller than that of the inner core 210. In such an example, the muzzle brake 230' may have a length that is smaller than the length of the brake-receiving recess 212. Such a configuration allows the coupling portion 218 (shown as threads) on the inner core 210 to engage the coupling portion 236' (also shown as threads) on the muzzle brake 230', thereby allowing the inner core 210 to couple to the muzzle brake 230'. As previously introduced, the muzzle brake 230' may have a nominal bore size that is smaller than the nominal bore size of the inner core 210.

Allowing the inner core 210 to thus couple to both the muzzle brake 230, shown in FIG. 2B, and to the muzzle brake 230', shown in FIG. 3, the suppressor system 200 may allow for backward compatibility between calibers since the inner core 210 may be coupled to muzzle brakes (and associated rifles) of the same or smaller diameters. The suppressor system 200 may also help minimize the possibility that inner cores will be used with incompatible firearms and the associated muzzle brakes.

Figure 4A:
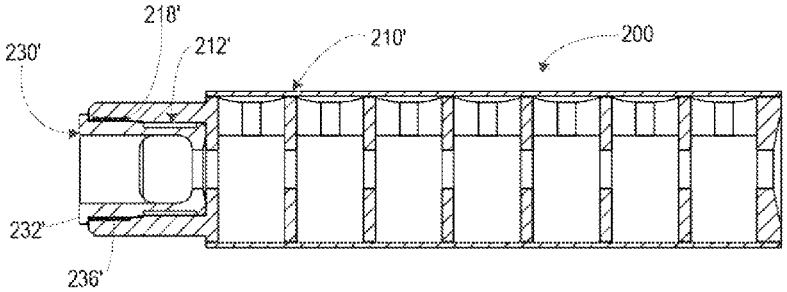
FIG. 4A illustrates a cross sectional view of a suppressor system, according to one example.

In particular, FIG. 4A illustrates the muzzle brake 230' coupled to an inner core 210' of the same nominal bore size. As previously discussed, the suppressor system 200 is such that inner cores are configured to thread into engagement with muzzle brakes with the same or smaller nominal bore sizes while preventing the coupling of incompatible muzzle brakes.

Figure 4B:
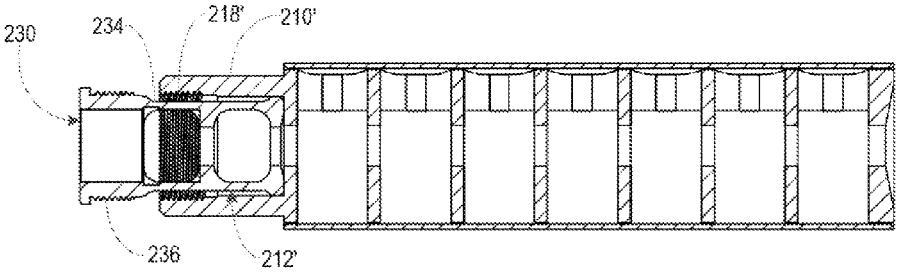
FIG. 4B illustrates a cross sectional view of a suppressor system, according to one example.

In particular, FIG. 4B illustrates the muzzle brake 230 in proximity to the inner core 210'. The muzzle brake 230 has a larger nominal bore diameter than that of the inner core 210'. As a result, the muzzle brake 230 is configured to fire a larger caliber bullet than can pass through the inner core 210'. It may be desirable to prevent the unintended coupling of the inner core 210' to the muzzle brake 230.

In such an example, protrusion 234 may have a length that prevents the coupling portion 218' of the inner core 210' from engaging the coupling portion 236 on the muzzle brake 230, thereby preventing the inner core 210' from properly coupling to the muzzle brake 230. In particular, the end of the protrusion 234 may abut against the second end of the protrusion-receiving recess 212'. The abutment may maintain some portion of the muzzle brake 230 exterior to the inner core 210', such as to maintain the coupling portion 236 exterior to the brake-receiving recess 212'.

Maintaining the coupling portion 236 exterior to the brake-receiving recess 212' maintains the coupling portion 218' separated from the coupling portion 236. In the illustrated example, this contact prevents the threads associated with each of the coupling portions 218', 236 from threading together. Preventing the threads from thus engaging may prevent proper coupling of the muzzle brake 230 and the inner core 210', thus helping reduce the likelihood that muzzle brakes will be used with inner cores having smaller nominal bore sizes.

In several examples, including those illustrated in FIGS. 2A-4B, the number of brake baffles 238, 238' on each of the muzzle brakes 230, 230' is related to the nominal bore sizes and/or the range of nominal bore sizes such that muzzle brakes with larger bore diameters have more brake baffles 238.

As seen in FIGS. 3-4B, muzzle brake 230 has a nominal bore size corresponding to a .338 caliber rifle and includes two brake baffles 238 while muzzle brake 230' has a nominal bore size corresponding to a .308 caliber rifle and includes one brake baffle 238. Accordingly, inner cores provided with suppressor system 200 that are configured to couple with a muzzle brake with a given number of brake baffles are able to safely couple to muzzle brakes having the same or fewer number of brake baffles.

As shown in FIG. 2A, an indication of the size of the muzzle brake 230 that is configured to couple with the inner core 210 is provided on the sleeve 220. In particular, symbols 222 or other visual indicia corresponding in number and shape to the maximum number of brake baffles 238 of the muzzle brake 230, with the largest nominal bore configured to properly couple with the inner core 210, can be formed on the sleeve 220 or any other portion of the suppressor system 200.

In at least one example, the symbols 222 may be machined into the sleeve 222. Such a configuration may allow an operator to readily determine if an inner core 210/sleeve 210 assembly may be properly coupled at a glance by comparing, the number of symbols 222 on the sleeve 220 to the number of brake baffles 238 on the muzzle brake 230. If the number of brake baffles 238 on the muzzle brake 230 is equal to or less than the number of symbols 222 on the sleeve 220, the inner core 210 (to which the sleeve 220 is secured) may be properly coupled to the muzzle brake 230.

It will be appreciated that the muzzle brakes and the inner cores may have any configuration that allows inner cores to couple with muzzle brakes having the same or smaller nominal bore diameters while preventing coupling of muzzle brakes to inner cores having smaller nominal bore diameters. In the example shown in FIG. 2B, the muzzle brake 230 is approximately 1.875 inches from the shoulder 234 to the second end. In particular, the coupling portion 236 may be approximately 0.5 inches in length while the protrusion 234 may extend approximately 1.375 inches from the coupling portion 236. The brake-receiving recess 212 and the interior-coupling portion 218 have a combined length that allows the protrusion 234 to extend into the brake-receiving recess 212 sufficiently to allow the coupling portion 236 to engage the interior-coupling portion 218 to the desired extent to couple the inner core 210 to the muzzle brake 230. In at least one example, the coupling portion 236 and the brake-receiving recess 212 may have a combined length of approximately 2.0 inches, thereby leaving a slight gap between the protrusion 234 and the inner core 210. The protrusion 234 has a length that establishes a clearance fit between the coupling portion 236 of the muzzle brake 230 and coupling portions of inner cores having smaller nominal bore diameters than that of the muzzle brake 230.

In the example illustrated in FIG. 4A, the coupling portion 218' and the brake-receiving recess 212' may have a combined length of approximately 1.35 inches, which accommodates the muzzle brake 230' as shown. In particular, the muzzle brake 230' shown may be approximately 1.19 inches from the shoulder 232' to the second end of the protrusion 234' in which the coupling portion 236' may be approximately 0.5 inches in length while the protrusion 234' may extend approximately 0.69 inches from the coupling portion 236'. The size of the receiving recess 212' and the coupling portion 218' therefore allows the muzzle brake 230' to couple to the inner core 210'.

However, as shown in FIG. 4B, the protrusion 234 of the muzzle brake 230 is sufficient to establish a clearance fit between the second end of the coupling portion 218' of the inner core 210' and the first end of the protrusion 234.

The suppressor system 200 may be further configured to help reduce the potential for coupling inner cores to muzzle brakes with larger bore diameters than the bore diameters of the inner cores. For example, as shown in FIGS. 4A-4B, the muzzle brake 230 with a relatively longer protrusion 234 may have a larger number of brake baffles 238.

In the examples shown and discussed above, two bore sizes are shown with the exemplary muzzle brakes and inner cores. It will be appreciated that any number of bore sizes may be implemented, such as by providing protrusions and brake-receiving recesses of appropriate sizes. Further, any number of brake baffles may be provided to correspond to any number of nominal bore sizes or calibers as desired.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A suppressor system, comprising:

at least one inner core having a core bore defined therein, the core bore having a nominal core bore diameter, the inner core further comprising a core-coupling portion; and a plurality of muzzle brakes, each of the plurality of muzzle brakes having a brake bore defined therein having a nominal brake bore diameter, each muzzle brake further comprising a brake-coupling portion, wherein the inner core is configured to allow the brake-coupling portions of muzzle brakes having nominal brake bore diameters that are equal to or less than the nominal core bore diameter to couple to the core-coupling portion and to prevent the brake-coupling portions of muzzle brakes having nominal brake diameters that are greater than the nominal core diameter from coupling to the core-coupling portion.

2. The system of claim 1, wherein the core-coupling portion comprises inner threads and wherein the brake-coupling portion comprises outer threads.

3. The system of claim 1, wherein the inner core further comprises a brake-receiving recess and wherein each of the muzzle brakes further comprise a protrusion configured to be received at least partially within the brake-receiving recess such that the brake-receiving recess has a length that allows the brake-coupling portions of muzzle brakes having nominal brake bore diameters that are equal to or less than the nominal core bore diameter to couple to the core-coupling portions and to prevent the brake-coupling portions of muzzle brakes having nominal brake diameters that are greater than the nominal core diameter from coupling to the core-coupling portions.

4. The system of claim 3, wherein the muzzle brakes having nominal brake bore diameters that are equal to or less than the nominal core bore diameter have protrusions with lengths that are equal to or lesser than the length of the brake-receiving recess.

5. The system of claim 4, wherein muzzle brakes having nominal brake bore diameters that are greater than the nominal core bore diameter have protrusions sufficiently long to interfere with the brake-receiving recess to prevent the brake-coupling portions from coupling with the core-coupling portions.

6. The system of claim 4, wherein muzzle brakes having nominal brake bore diameters that are greater than the nominal core bore diameter have protrusions sufficiently long to interfere with the brake-receiving recess to provide a clearance fit between the brake-coupling portions and the core-coupling portions.

7. A suppressor system, comprising:

at least one inner core having a core-coupling portion and further including a core bore and a brake-receiving recess defined therein, the core bore having a nominal core bore diameter; and a plurality of muzzle brakes, each of the muzzle brakes having a brake bore defined therein and having a protrusion and a brake-coupling portion, wherein the muzzle brakes having nominal brake bore diameters that are equal to or less than the nominal core bore diameter have protrusions sized to be sufficiently received within the brake receiving recess to allow the core-coupling portions to engage the brake-coupling portions to thereby couple the inner core to the muzzle brakes.

8. The suppressor system of claim 7, wherein muzzle brakes having nominal brake bore diameters that are greater than the nominal core bore diameter include protrusions having lengths that prevent the core-coupling portions from engaging the brake-coupling portions and thereby prevent coupling of the inner core to the muzzle brakes.

9. The suppressor system of claim 7, wherein the brake-receiving recess includes a first end and a second end, wherein the core-coupling portion is associated with the first end.

10. The suppressor system of claim 9, where the muzzle brake includes a first end and a second end and wherein the brake-coupling portion is associated with the first end of the nuzzle brake.

11. The suppressor system of claim 10, wherein muzzle brakes having nominal brake bore diameters that are greater than the nominal core bore diameter include protrusions having lengths causing the second ends of the protrusions to contact the second ends of the brake-receiving recess while preventing engagement of the brake-coupling portions and the core-coupling portion.

12. The suppressor system of claim 7, wherein muzzle brakes having nominal brake bore diameters equal to the nominal core bore diameter include a plurality of brake baffles defined in the protrusions.

13. The suppressor system of claim 12, wherein muzzle brakes having nominal brake bore diameters that are less than the nominal core bore diameter have fewer brake baffles defined in the protrusions than muzzle brakes having nominal brake bore diameters equal to the nominal core diameter.

14. The suppressor system of claim 13, further comprising an outer sleeve coupled to the inner core, the outer sleeve having visual indicia formed thereon corresponding to the number of brake baffles associated with muzzle brake having the nominal brake bore diameter that are equal to the nominal core bore diameter.

15. A suppressor system, comprising:

a first inner core having:

a first core bore defined therein having a first nominal core bore diameter, a first brake receiving recess defined therein having a first recess length, and a first brake coupling portion associated with the first brake receiving recess;

a second inner core having:

a second core bore defined therein having a second nominal core bore diameter, the second core bore diameter being smaller than the first core bore diameter, a second brake receiving recess defined therein having a second recess length, the second recess length being shorter than the first recess length, and a second brake coupling portion associated with the second brake receiving recess;

a first muzzle brake having a first brake bore defined therein having a first nominal brake bore diameter, the first nominal brake bore being equal to or less than the first nominal core bore diameter, and a first protrusion configured to be received within the first brake receiving recess to allow the first inner core to couple to the first muzzle brake; and a second muzzle brake configured to couple to the second inner core and having a second brake bore defined therein having a second nominal brake bore diameter, the second nominal brake bore being equal to or less than the second nominal core bore diameter, and a second protrusion configured to be received within the second brake receiving recess to allow the second inner core to couple to the second muzzle brake, wherein the second protrusion is of a length to be received within the first brake receiving recess to allow the second muzzle brake to couple with the first inner core and the first protrusion of a length to prevent the first muzzle brake from coupling with the second inner core.

16. The suppressor system of claim 15, wherein the first muzzle brake further includes a plurality of brake baffles defined therein and the second muzzle brake includes at least one brake baffle defined therein, the second muzzle brake including fewer brake baffles defined therein than the first muzzle brake.

17. The suppressor system of claim 16, further comprising an outer sleeve coupled to the first inner core, the outer sleeve having visual indicia formed thereon corresponding to the number of brake baffles associated with first muzzle brake having the first nominal brake bore diameter that are equal to first the nominal core bore diameter.

* * * * *